US005114267A

United States Patent [19]

Smith et al.

[11] Patent Number: 5,114,267

[45] Date of Patent: May 19, 1992

[54] INTEGRATED PAVER WITH WINDROW PICK-UP CAPABILITY

[75] Inventors: Donald W. Smith, Aurora; James J. Plociennik, North Aurora; George Goehst, Plano; Andrew Green, Geneva, all of Ill.

[73] Assignee: Caterpillar Paving Products, Inc., Peoria, Ill.

[21] Appl. No.: 599,257

[22] Filed: Oct. 16, 1990

Related U.S. Application Data

[63] Continuation of Ser. No. 309,080, Feb. 10, 1989, abandoned.

[51] Int. Cl.[5] ..... E01C 19/02

[52] U.S. Cl. ..... 404/83; 404/108; 404/91

[58] Field of Search ..... 404/83, 84, 91, 92, 404/101, 108, 75; 198/313, 513, 589, 632, 861.4; 414/502, 523, 528; 37/8, 101, DIG. 20; 172/4.239

[56] References Cited

U.S. PATENT DOCUMENTS

| | | | |
|---|---|---|---|
| 1,768,657 | 7/1930 | Baker | 404/91 |
| 1,958,460 | 5/1934 | Barber | 198/513 X |
| 2,064,807 | 12/1936 | Barber | 404/92 |
| 2,835,098 | 5/1958 | Scheidenhlem | 198/506 X |
| 3,091,999 | 6/1963 | MacDonald | 404/101 |
| 3,693,512 | 9/1972 | Smith | 404/101 |
| 3,903,623 | 9/1975 | Hyler | 37/8 |
| 4,200,408 | 4/1980 | Babler et al. | 404/83 |
| 4,304,504 | 12/1981 | Trujillo | 404/108 |
| 4,676,688 | 6/1987 | Caradot | 404/91 |
| 4,837,950 | 6/1989 | Vesper | 37/8 X |

FOREIGN PATENT DOCUMENTS

| | | |
|---|---|---|
| 244708 | 11/1987 | European Pat. Off. . |
| 849827 | 7/1952 | Fed. Rep. of Germany . |
| 2845680 | 4/1980 | Fed. Rep. of Germany . |

OTHER PUBLICATIONS

CMI Paver with Windrow Pick-Up.

Barber-Greene's BG-610H Hydrostatic Windrow Elevator.

*Primary Examiner*—Ramon S. Britts

*Assistant Examiner*—Gay Ann Spahn

*Attorney, Agent, or Firm*—Jones, Day, Reavis & Pogue

[57] ABSTRACT

An integrated paver comprising a self-propelled chassis having a paving apparatus, such as a screed, supported on its rear end and a lifting conveyor supported on its front end. The conveyor is capable of picking-up loose paving material laid in the windrow on the road surface. It is pivotally supported on a mounting which is in-turn pivotally supported on the chassis such that the conveyor can be adjusted in two dimensions relative to the chassis. Grade controls on the conveyor control hydraulic cylinders to adjust the tilt and grade of the conveyor relative to the road surface. Alternatively, the conveyor can rest, by force of gravity on runners which slide along the ground and hold the conveyor head a predetermined height (possibly zero) above the ground. Additionally, the runners can be linked to floating break-away scrapers which are maintained at a set position relative to the runners. The conveyor drag chain rides over an idler shaft above and in front of the inlet end supporting shaft of the chain such that the paddles on the chain travel at close to 45° to the road surface to reduce vibration and the slapping action of the paddles against the windrow.

44 Claims, 7 Drawing Sheets

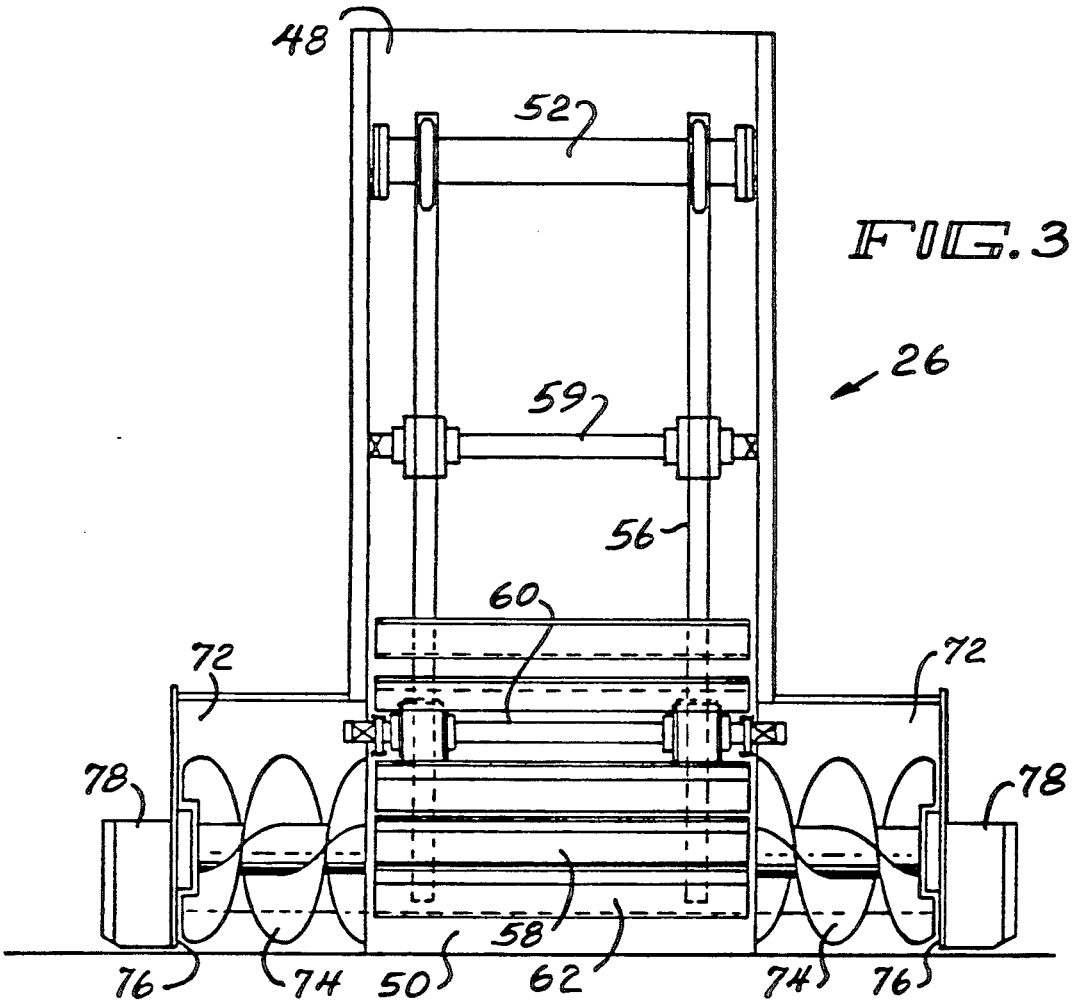
FIG. 3
FIG. 4
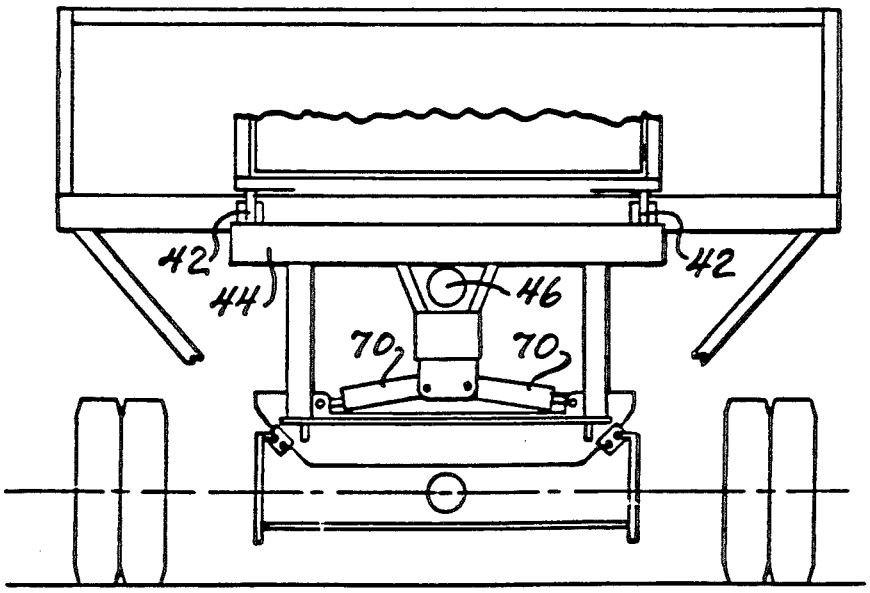

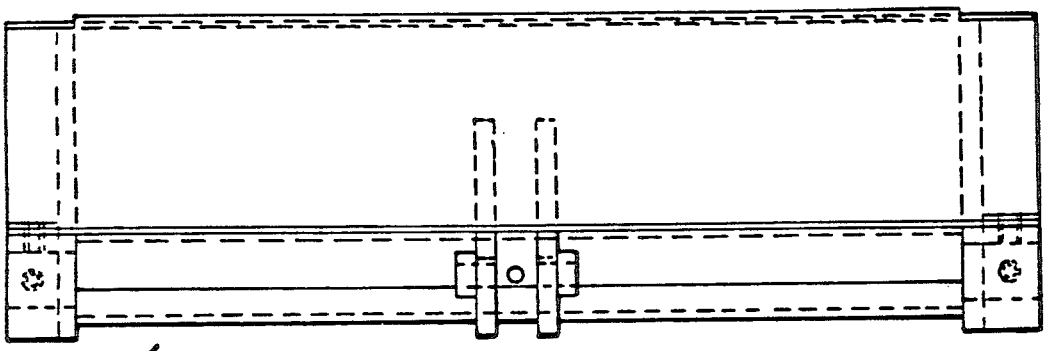
FIG. 9
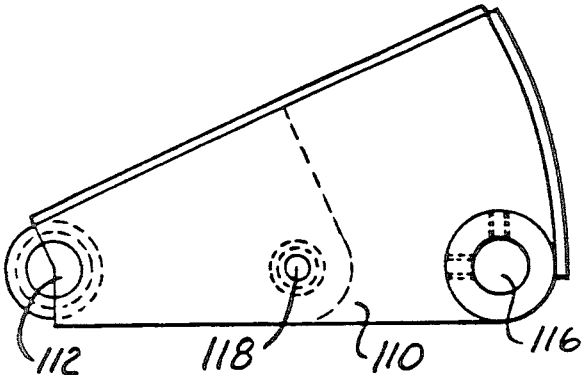
FIG. 10
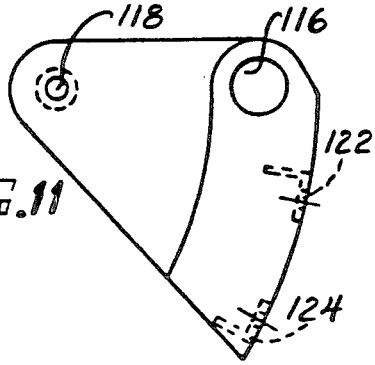
FIG. 11
FIG. 12
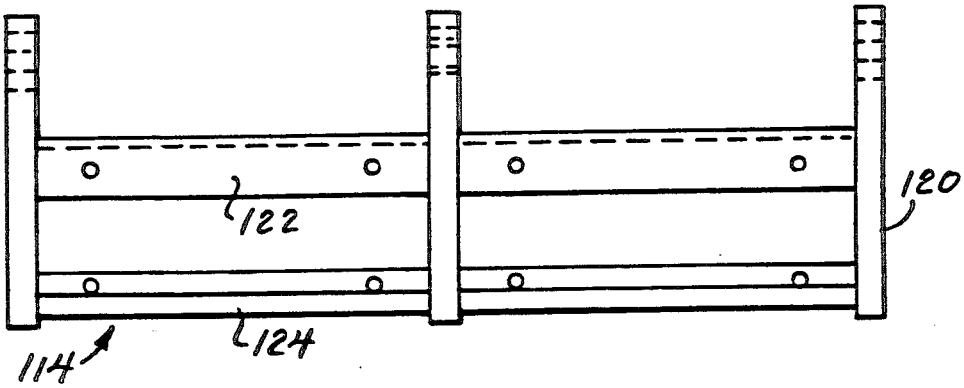

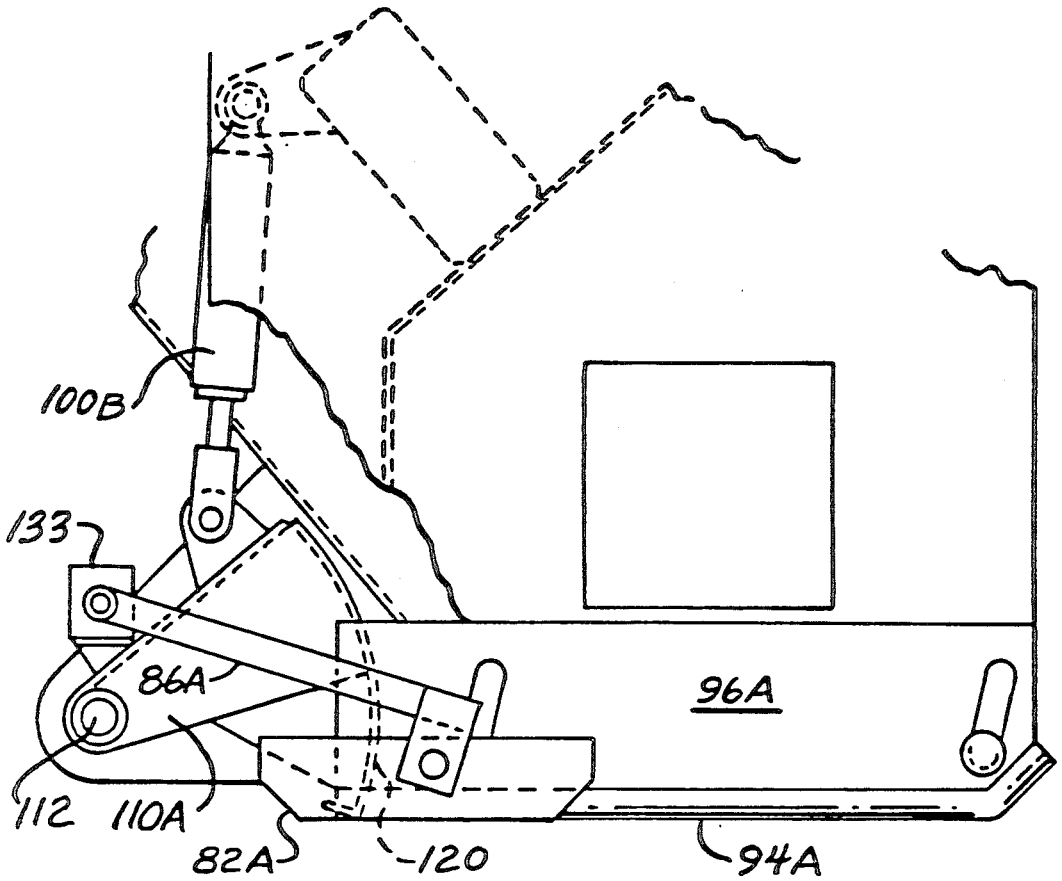
FIG. 13
FIG. 14
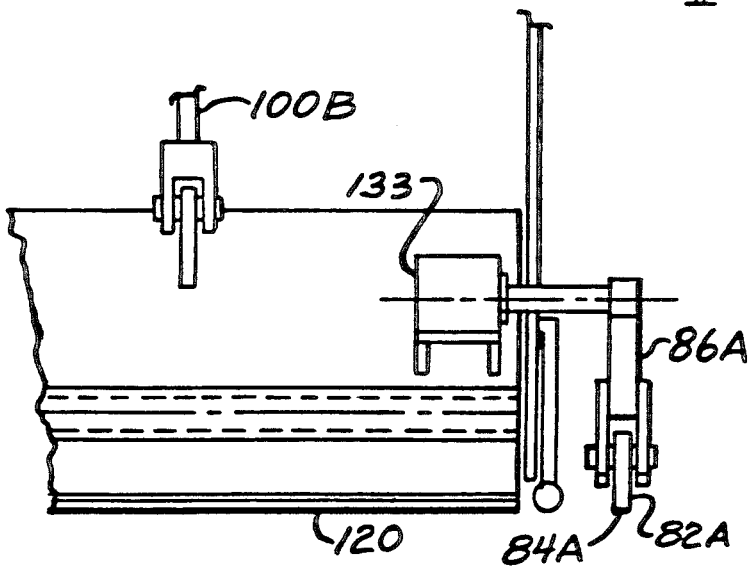

INTEGRATED PAVER WITH WINDROW PICK-UP CAPABILITY

This application is a continuation, of application Ser. No. 309,080, filed Feb. 10, 1989, now abandoned.

BACKGROUND OF THE INVENTION

The invention relates to machines for paving roads. In particular, the invention pertains to self-propelled paving machines capable of picking-up a windrow of loose paving material without the assistance of additional equipment.

In the past, pavers were independent machines which evenly distributed loose paving material from a holding bin or hopper in the paver to the road directly in front of a screed supported on the paver to produce a road surface from loose paving material. The loose material was previously dumped into the hopper or holding area of the paver by use of a dump truck or other separate apparatus. More recently, Astec Industries developed a "shuttle buggie" device, which is the subject of U.S. patent application Ser. No. 89,318. The shuttle buggie transports paving material from a dump truck or a windrow to the paver and then discharges the paving material into the paver by way of a conveyor.

Employing a single machine to pick up loose paving material laid in a windrow and pave the surface over which the machine passes avoids the need for separate windrow pick-up or "shuttle buggie" machines. Prior attempts have been made to develop such a combined pick-up and paving device, such as that shown in the Babler U.S. Pat. No. 4,200,408 (a similar device also was built by CMI Corporation).

The '408 patent shows a pavement laying apparatus equipped with an upwardly inclined chute hinged on a hopper front wall and a conveyor supported on the front of the paver. This type of device suffers from several problems. First, any loose paving material which gets beyond the chute will travel beneath the wheels of the paver causing the paver to rise above the road surface. As the paver rises above the road surface, the chute will be carried to a higher level above the road surface and allow yet more paving material from the windrow to travel under the paver and raise the paver even further. This process will continue until a significant portion of the windrow is not picked up by the chute and the paving function of the machine is seriously disrupted.

A second problem with the Babler-type of paver is that it cannot adjust to the road grade relative to the rest of the paver, i.e. it is fixedly attached to the paver about that axis. Additional problems include the fact that on the Babler-type paver, the chute and flight conveyors contained in the chute must be as wide as the windrow or, if not, guide plates are used to funnel the windrow into the chute. Often these guide plates allow a significant amount of paving material underneath the chute or are lifted above the ground when the paver rolls over loose material which passes under the conveyor.

Another problem apparent in the Babler device is the danger of the chute violently colliding with a hidden obstruction. For example, the Babler paver would violently collide with a manhole cover buried under a windrow of paving material causing damage to the chute or other parts of the paver and, possibly, injury to the operator.

It is an object of the present invention to provide an improved integrated paver having windrow pick-up capability.

It is another object of the present invention to provide a paver having front apparatus for picking-up a windrow of paving material and depositing it into the paver, the front apparatus having the ability to pivot to adjust for both tilt and grade adjustments relative to the rest of the paver.

It is yet another object of the present invention to provide a paver which can at least semi-automatically adjust the tilt of the conveyor relative to the paver in order to avoid a gradual lifting of the paver off the road surface because of leakage of paving material past the conveyor.

It is further an object of the present invention to provide a conveyor which will not violently collide with manhole covers or other obstructions hidden in the windrow.

It is yet another object of the present invention to provide a way of feeding a windrow which is wider than the conveyor into the conveyor without the attendant problem of using funneling guides.

It is yet a further object of the present invention to provide a conveyor which will have reduced vibrations and be more efficient in conveying the loose paving material in the windrow into the paver hopper.

Other and further objects will become apparent from the following discussion of the invention and its embodiments.

SUMMARY OF THE INVENTION

In accordance with this invention, a paver has a self-propelled chassis that has a hopper or holding area for loose paving material. The chassis has a forward end and a rear end; a lifting conveyor is pivotally connected to the forward end of the chassis, and a paving apparatus, normally a screed, is attached in a way known in the art at the rear end of the chassis.

The lifting conveyor is pivotally supported on the forward end of the chassis to be able to pivot in one or two dimensions relative to the chassis. The conveyor is pivoted in two dimensions by pivotally supporting the conveyor on a mounting which is pivotally supported on the chassis about the line of movement of the chassis to allow for grade adjustments relative to the chassis. Hydraulic cylinders are attached from the chassis to both the mounting and the conveyor to effect adjustments for tilt and grade variations.

The conveyor has a discharge end located above the hopper and an input end adjacent the road surface. The input end is associated with various apparatus to feed as much of the windrow as possible into the conveyor and, ultimately, into the paver hopper. The feed means includes screw conveyors located on either side of the input end of the conveyor to feed the paving material from the sides of the windrow into the conveyor. These screw conveyors are driven by the shaft that supports the drag chain of the conveyor near the input end.

When desired, scrapers are attached behind the conveyor at its inlet end. The scrapers are pivotally adjustable in a plurality of positions relative to the conveyor and act to scrape the road surface as clean as possible of paving material in order to reduce or eliminate escape of paving material under the lifting conveyor.

In the event that loose paving material does travel past the scrapers, the paver chassis will begin to ride slightly above the road surface as it rolls over the material. As mentioned previously, this can cause the entire paver including the conveyor to lift off the road surface and become less effective at picking up the loose paving material. As more paving material escapes the scraper, the paver further raises above the road surface. As this cycle continues, the conveyor becomes less and less effective at picking-up the loose material in the windrow.

Two distinct strategies are employed by the present invention to assure that the conveyor head is properly oriented to the surface to be paved. First, the conveyor can be primarily controlled at its connection to the chassis. Or, alternatively, the interface between the conveyor head and the road surface is controlled by scrapers at the conveyor head. Of course, a combination of these two strategies could be utilized without departing from the presently contemplated invention.

With respect to the first strategy, the conveyor head has grade sensors on either side of the conveyor which ride along the road surface. One of these grade sensors at least partially controls the tilt of the conveyor relative to the chassis, while the other at least partially controls the grade of the conveyor relative to the chassis. The grade controls relay information to the hydraulic cylinders attached between the conveyor and the chassis to make adjustments to the conveyor in order to minimize escape of loose paving material past the conveyor head.

An alternative method within the first strategy to control the escape of paving material is to allow gravity to push the conveyor head against the ground. To avoid too much pressure being applied by gravity, hydraulic cylinders between the chassis and the conveyor can counterbalance the gravity forces such that the head still rides on the ground surface, but without undue pressure against the ground.

With respect to the second strategy, scrapers are attached to the conveyor head, the scrapers are controlled by runners attached to the conveyor head which ride on the ground surface. A predetermined spacing is maintained between the runners and the scrapers such that a uniform thickness of paving material in the windrow (which could be zero) can pass under the conveyor. Having runners on either side of the conveyor head independently controlling scrapers on each side provides for variations in the grade of the surface to be paved.

The invention contemplates the additional feature that the conveyor has a drag chain which rolls over a series of shafts, including one at each end of the conveyor, and supported by an idler shaft located forward and above the conveyor shaft at the inlet end of the conveyor. Because of the location of this idler shaft, the drag chain does not completely reverse directions around the shaft at the inlet end, but merely makes a 90° turn. Thus, the drag chain travels at about a 45° angle to the road surface and has a more efficient motion against the loose paving material in the windrow. This motion also reduces the vibration and slapping of the paddles against the windrow.

BRIEF DESCRIPTION OF THE DRAWINGS

FIG. 3 is a front elevational view of the paver of FIG. 1 with guard and cover removed.

FIG. 4 is a front elevational view of the present invention with the conveyor removed to expose the conveyor mounting.

FIG. 9 is a front elevation of a scraper brace for the scraper shown in FIG. 8.

FIG. 10 shows a side elevational view of the scraper brace of FIG. 9.

FIG. 11 shows a side elevational view of the breakaway scraper of FIG. 8.

FIG. 12 shows a front elevational view of the breakaway scraper of FIG. 11.

FIG. 13 shows a side elevational view of a third alternative embodiment of the present invention.

FIG. 14 shows a rear elevational view of the embodiment of FIG. 13.

DETAILED DESCRIPTION OF THE INVENTION

Figure 1:
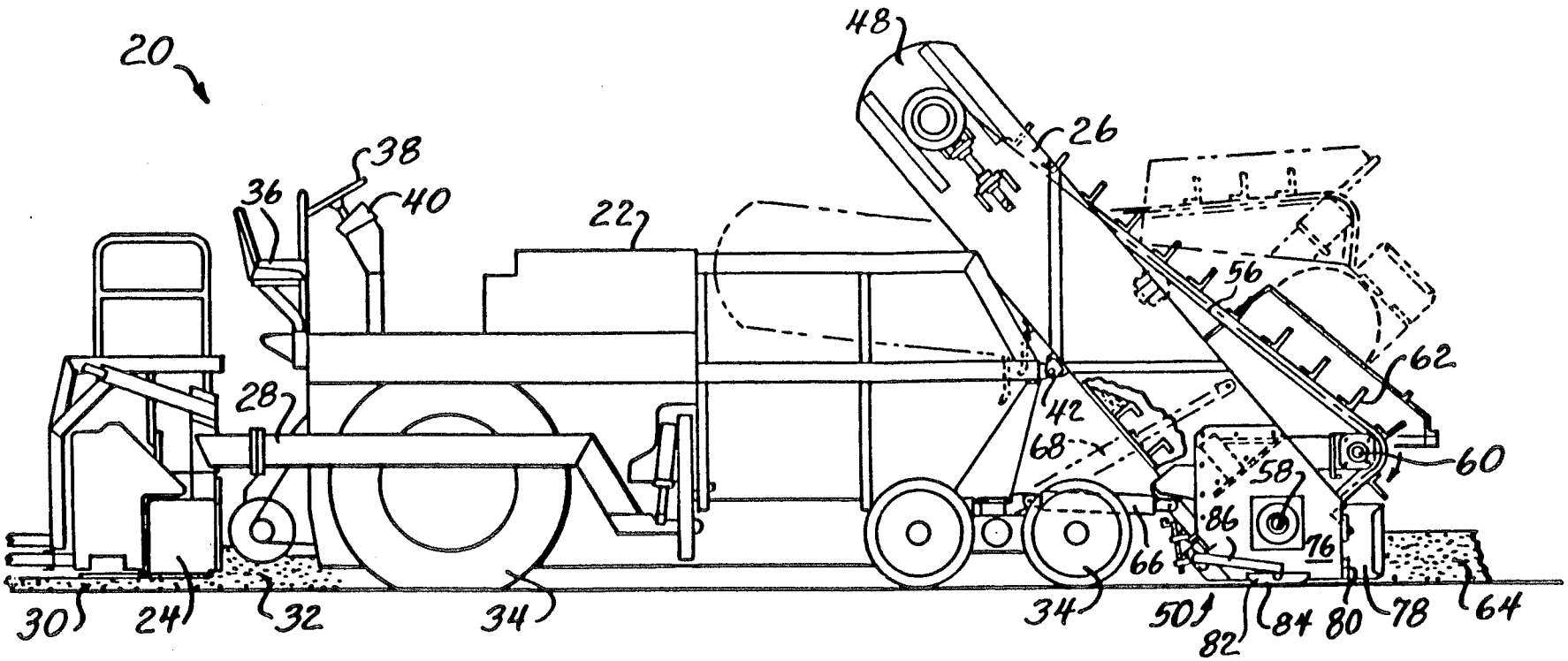
FIG. 1 is a side elevational view of the paver of the present invention.
Figure 2:
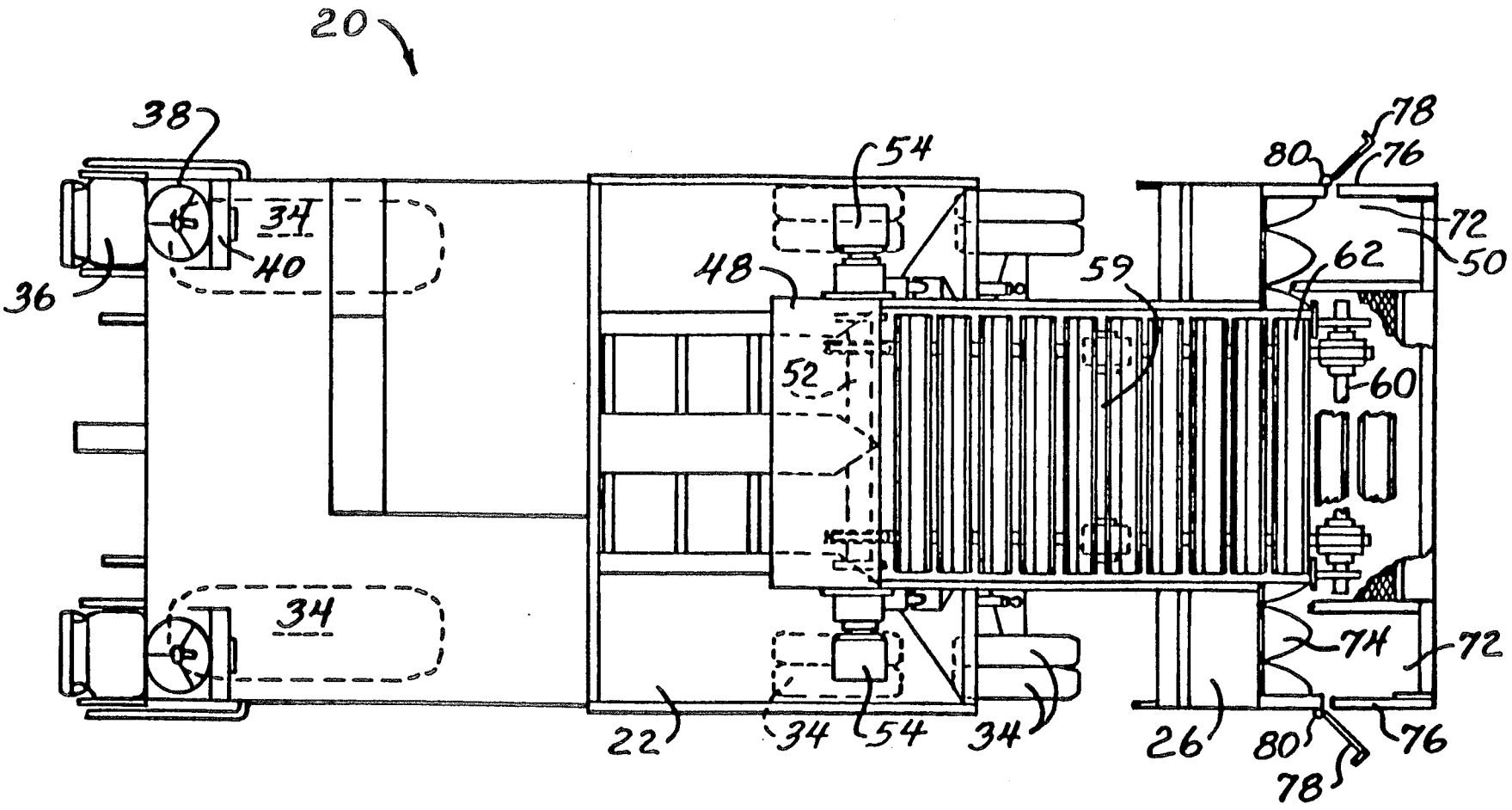
FIG. 2 is a top plan view of the paver of the present invention with screed portion removed.

The integrated paver of the present invention and its component parts may be understood by reference to the diagrams described above. Referring first to FIGS. 1–4, the paver is generally designated as 20. The paver 20 is comprised of three general components: the chassis 22, the screed 24 and the conveyor 26. The screed is secured to the paver in a manner known in the art at the rear end of the paver. Screed connector bars 28 secure the screed in a position behind the paver such that it can produce a road surface 30 from loose paving material 32 deposited behind the paver.

The chassis is supported on wheels 34 and is self-propelled by a power system contained within the chassis. Of course, the unit could also be supported on tracks or utilize any other means known in the art for moving large machines. The operator of the unit sits on the operator's chair 36 from where he can direct the paver by steering wheel 38 and can control the hydraulic and other controls on console 40 to fully operate the paver.

The conveyor 26 is pivotally attached to the front of the chassis 22 at pivot connections 42 shown at FIGS. 1 and 4. However, the conveyor is not directly connected to the chassis at pivot connector 42, but to a mounting 44 which is in-turn pivotally connected to the chassis at pivot connector 46. This pivot connector allows the mounting 44 to be swung from side to side thereby adjusting the conveyor relative to the chassis in the direction of the grade of the road. Preferably, the mounting 44 (and in turn the conveyor 26) can be adjusted 4° in either direction from the normal relative to the chassis. Alternatively, maximum grade adjustments of a greater or less angle is contemplated by the invention.

The conveyor, generally, has two ends; a discharge end 48 and an inlet end 50. The discharge end is the high end of the conveyor at which the loose paving material is discharged into the chassis. It has a shaft 52 that is driven by motors 54 to actuate drag chain 56 in the conveyor. A second shaft 58 and a third shaft 59 both passively support the drag chain as it travels the length of the conveyor. An idler shaft 60 is situated above and in front of conveyor shaft 58 and carries the drag chain 56 in front of the shaft 58 such that the drag chain makes only a 90° change in direction around shaft 58. Accordingly, the drag chain paddles 62 intercept the windrow of paving material 64 at about a 45° angle and do not begin to change direction until reaching the middle of drive shaft 58, at which point they change direction in order to return to drive shaft 52. This arrangement reduces vibrations normally caused when the paddle of the drag chain completely reverses direction (by 180°) around shaft 58 at the same time the paddles come in contact with the paving material in the windrow 64. Also, the slapping action of the paddle 62 against the windrow 64 is reduced.

The tilt of the conveyor 26 relative to the chassis 22 is controlled by hydraulic cylinder 66 shown in the lowered position (shown fully extended as 68 in a typical orientation for transport of the paver 20). Grade adjusting hydraulic cylinders 70 (shown in FIG. 4) are attached between the chassis and the mounting in order to control the grade adjustment of the conveyor relative to the chassis. Second hydraulic cylinders 70 can expand or contract in order to effect up to a 4° swing in either direction relative to the chassis. This allows for adjustment of the conveyor to the grade of the road up to 4° different from the plane of the chassis.

The inlet end of the conveyor has a widened area 72 on both sides of the drag chain 56. This allows for the drag chain to convey material from the windrow 64 which is wider than the width of the drag chain 56. The conveyor shaft 58, which is turned by the movement of the drag chain 56, has screw conveyors 74 extending the width of widened portions 72. These screw conveyors 74 convey the paving material in the windrow which is on the sides of the windrow and which would not be conveyed directly by drag chain 56. As the screw conveyors 74 turn they convey the material in the wide part of the windrow that reaches the inlet end of the conveyor towards the drag chain where it is then conveyed up the conveyor toward the discharge end 48.

The inlet end of the conveyor has side walls 76 and extending wing 78. The extended wing 78 acts as a funnel to scoop paving material into the inlet end which would not otherwise be picked up by the inlet end of the conveyor. These wings 78 are pivotally attached to the inlet side walls 76 at hinge 80.

A grade sensor 82 is located at both side walls and has flat bottom portion 84 which rides along the road surface. The grade control is pivotally supported on rocker arm 86 which controls the hydraulic cylinders 68 and 70. If the road surface increases in height relative to the conveyor, the grade control 82 will move upward and will cause the cylinder 68 to raise the conveyor such that the conveyor head is as near to the road surface as possible, without undue scraping of the road surface.

The two grade sensors 82 at least partially automatically control the grade and tilt of the conveyor relative to the chassis. The grade sensor 82 on one side will control the tilt of the conveyor by automatically adjusting hydraulic cylinder 68. The grade sensor 82 on the opposite side will control the grade of the conveyor relative to the chassis by adjusting hydraulic cylinder 70 which controls the tilt of the mount upon which the conveyor is supported. As mentioned previously the grade control preferably allows a pivot of up to 4° in either direction.

The present invention contemplate alternative ways of assuring that pavement material in the windrow does not pass under the conveyor head. While the above-described embodiment utilizes grade controls to cause grade and tilt adjustments in two dimensions at the connection of the chassis with the conveyor, an alternative method, also controlling the conveyor at its connection to the chassis is contemplated.

Figure 5:
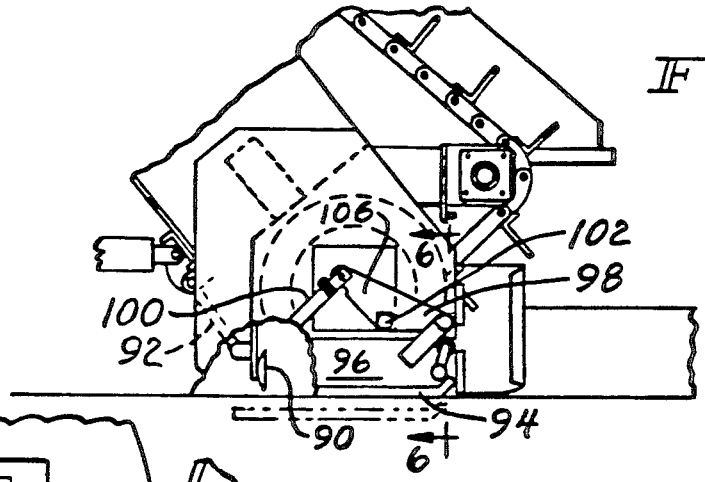
FIG. 5 is a side elevational view of the input end of the lifting conveyor partially cut-away showing an alternative embodiment of the present invention.
Figure 6:
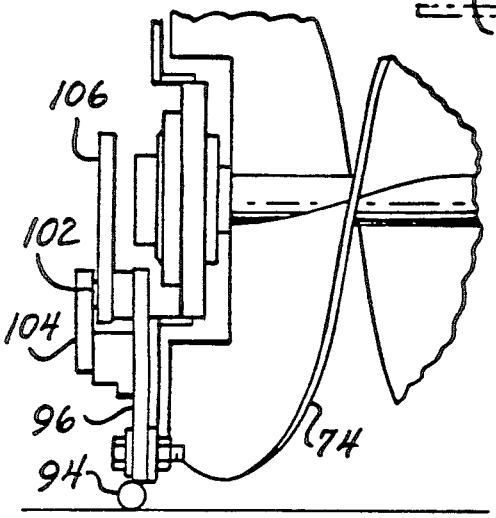
FIG. 6 is a sectional view of the alternative embodiment shown in FIG. 5 taken at section line 6—6.

With reference to FIGS. 5 and 6, rear scraper 90 is attached through linkage 92 to the conveyor such that it will ride adjacent the ground. Runner 94 which rides on the ground a s the conveyor is moved forward, is fixed at a predetermined distance with respect to the conveyor head such that pressure on the conveyor toward the ground will press the runner 94 against the ground but avoid scraping the conveyor head. The runner 94 is attached to a side gate 96 and side gate linkage 98 which assures that the runner 94 is maintained parallel to the ground.

The hydraulic cylinder 68 and pivotal connection 42 can be used to apply a counterbalance force against gravity of the conveyor head towards the ground. Specifically, runner 94 is attached to the bottom of side gate plate 96 which is connected through an armature 104 to triangular pivot plate 106 which is in-turn pivotally connected to the conveyor at pivot 102. The triangular pivot point 106 is connected at its opposite point to adjustable arm 100 which is connected to the side gate plate 96. Accordingly, extension of adjustable arm 100 will pivot plate 106 and re-position the gate 96 and runner 94, always keeping runner 94 parallel with the ground.

When cylinder 68 is being used to apply a counterbalance force, cylinder 70 is put in a free float position so that the conveyor head is free to pivot about pivotal connection 46. This ensures that the head will follow any transverse grade changes of the ground.

While gravity is used to push the conveyor head against the ground, the runner 94 maintains the head slightly above the surface of the ground to avoid scraping the scraper 90 against the ground, but while maintaining the scraper 90 as close to the ground as possible. However, it is desirable to apply a force at hydraulic cylinder 68 to counterbalance gravity forces which could be as much as 4000 lbs. at the point of the conveyor head against the runner, so that the runner 94 is only gently pushed along the ground. Such hydraulic force can be applied to relieve any amount of the gravity pressure but, preferably, allows a minimal amount of gravity to keep the head against the ground surface.

Figure 8:
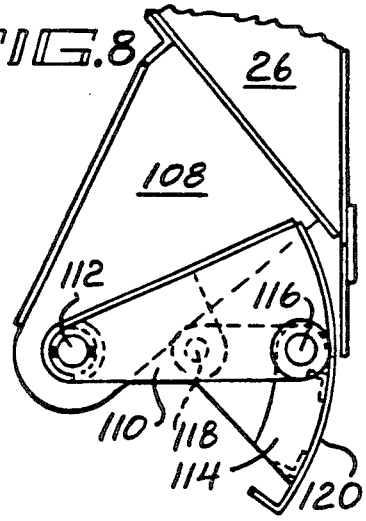
FIG. 8 shows the detailed side elevational view of the scraper of FIG. 7.
Figure 7:
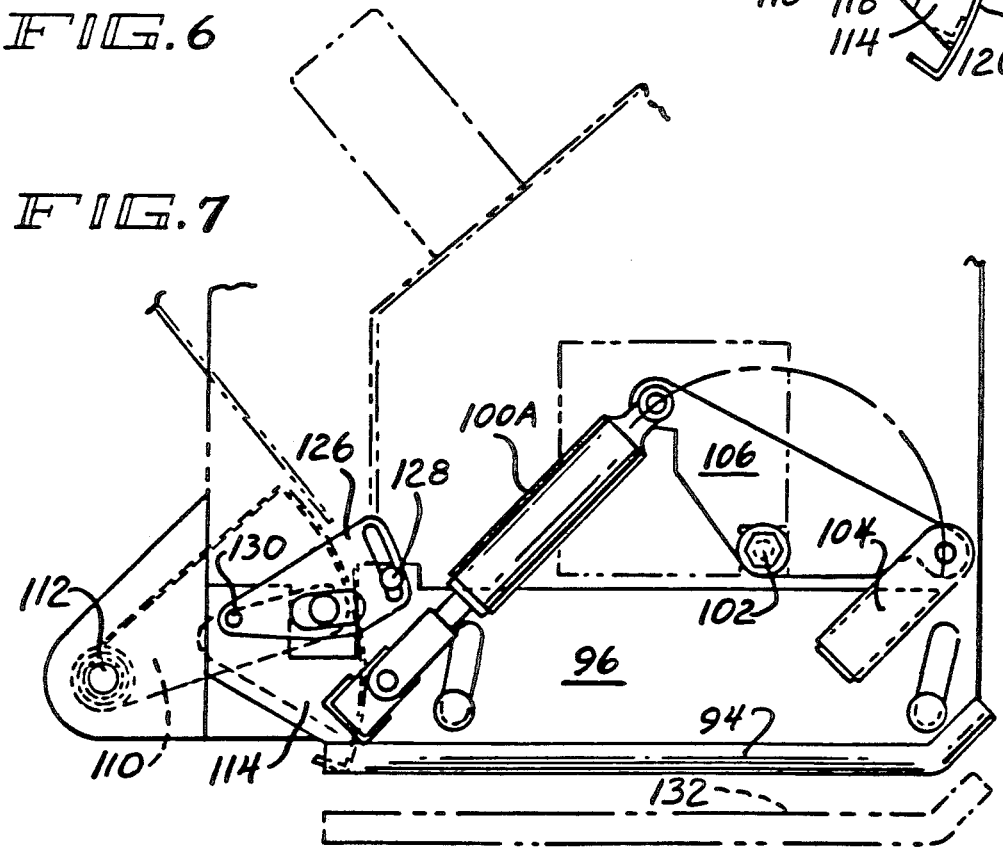
FIG. 7 is a side elevational view of a second alternative embodiment of the present invention.

As an alternative to scraper 90, a break-away scraper arrangement as shown in FIGS. 7 and 8 can be employed. Such a scraper is attached to the conveyor 26 by bracket 108 which is attached along one edge to the conveyor and departs downwardly away from the underside of the conveyor. A scraper bracket 110 (also shown in FIGS. 9 and 10) is pivotally attached to bracket 108 at bolt 112 such that it can pivot up and down as will be described below. A break-away scraper plate 114 is in-turn pivotally attached to scraper bracket 110 at bolt 116 and also at break-away point 118. Break-away plate 114 has curved surface 120 which will support a curved plate on two cross supports 122 and 124 (as shown in FIGS. 11 and 12).

In the event that the scraper shown in FIGS. 7-12 collides with a hidden object in the windrow, the breakaway scraper plate 114 will be forced rearwardly, shearing the small diameter shearing bolt at 118, and freely pivoting about the bolt at 116. Accordingly, a collision of the scraper with such a hidden, immovable object will not cause damage to the conveyor, or possibly, injury to the operator, but will only cause the shearing of the bolt at 118.

The second strategy contemplated by the present invention for avoiding paving material passing by the conveyor head is directed to maintaining a set distance (possibly zero) between the runner 94 and the scraper face 120. This is accomplished by a linkage plate 126 (FIG. 7) which connects gate plate 96 with scraper bracket 110 at slidable connection 128. The linkage plate 126 is pivotally attached to the conveyor at pivot hinge 130. Accordingly, movement of the runner upwards or downwards (shown at phantom lines 132 in FIG. 7) will cause an appropriate movement of scraper plate 120. Accordingly, a predetermined distance between the bottom of plate 120 and the runner 94 (set by adjustment of linkage 126 at slidable connection 128) will be maintained while runner 94 moves up and down as it rides over the ground.

When operating the adjustable gate as shown in FIG. 7, the break-away plate 120 can be set to ride even with the bottom of the runner 94, as shown in FIG. 7, or raised relative to the runner to allow a uniform mat of a predetermined thickness to be formed by the scraper 120 passing over the windrow.

In this arrangement, cylinder 100A (FIG. 7) replaces adjustable link 100 (of FIG. 5). By maintaining a preselected hydraulic pressure to extend cylinder 100A, the downward force of side gate 96 and runner 94 against the ground can be controlled to any desired value. In operation, the pressure is adjusted so that the downward force is just sufficient to hold runner 94 against the ground, thereby holding scraper 120 in a fixed relation to the ground through linkage 126.

The third strategy for avoiding paving material passing by the conveyor head is to control the distance between a scraper face 120 and the ground by means of a grade sensor 82A (FIGS. 13 and 14) with flat bottom portion 84A that rides along the road surface. Referring to FIG. 13, scraper bracket 110A is connected to the conveyor 26 through pivot 112. Scraper face 120 is connected to 110A in a break-away fashion as previously described. The height of scraper face 120 from the ground is controlled by cylinder 100B which can raise or lower bracket 110A and scraper face 120 about pivot 112.

There is a bracket 110A with scraper face 120 pivotally mounted on each side of the conveyor, generally behind the screw sections 74 and arranged to clear a path for the wheels 34 on each side of the paver.

Grade sensor 82A, working through arm 86A operates a grade control device 133, such as a rotary hydraulic proportional valve, mounted to pivoting bracket 110A. Proportional valve 133 controls hydraulic cylinder 100B to maintain the bottom of scraper face 120 at any desired distance above the bottom surface 84A of sensor 82A, which is riding on the road surface. The depth of material flowing under scraper face 120, and in the wheel path of the paver, is thereby controlled to a fixed height above the road surface compensating for any irregularities in the surface.

In this arrangement the inlet end of conveyor 126 is positioned at a convenient distance above the ground surface by means of cylinders 66. It is not necessary to also pivot the head about pivot 46 and cylinders 70 can be used to lock the head in a level position. Alternately, pivot 46 and cylinders 70 can be removed.

Figure 15:
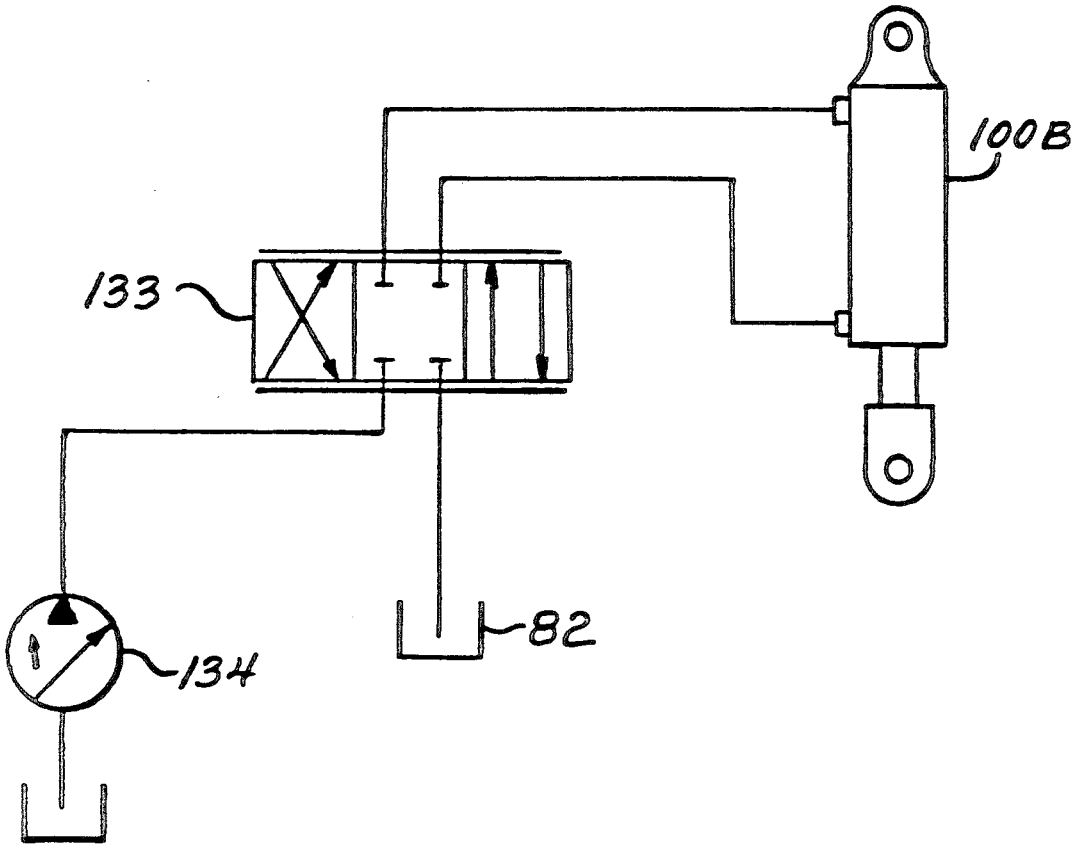
FIG. 15 shows a schematic diagram of the control system of the embodiment shown in FIGS. 13 and 14.

Hydraulic cylinder 100B is controlled by proportioning valve 133 as shown schematically in FIG. 15. Proportioning valve 133 is supplied with hydraulic oil at a constant, but adjustable pressure by hydraulic pump 134. Proportioning valve 133 responds to movement of ground sensor 82A through arm 86A, passing hydraulic oil to hydraulic cylinder 100B in proportion to the movement of arm 86A in order to maintain a preselected vertical distance between the bottom of sensor 82A (shown by surface 84A) and valve 133. Since valve 133 is mounted on bracket 100A with scraper face 120, the vertical distance between the bottom of scraper face 120 and the ground is maintained at a pre-selected distance. By adjusting the rotational mounting of arm 86A at its attachment to valve 133, the height of valve 133 and scraper face 120 from the ground can be adjusted to any desired distance.

One complete set comprised of a sensor 82A, a bracket 110A, a scraper face 120 and cylinder 100A can be mounted on each side of the machine to clear a path for both the right and left side wheels of the paver. Thus, the right and left sides are independently controlled by sensors on each side and grade adjustments between the right and left sides of the ground are automatically made.

As described previously with respect to FIG. 1, it is also possible to maintain the height of the bottom of the complete conveyor 48 from the ground by the use of grade sensors 82, one on each side of the machine. In this arrangement one sensor 82 on one side of the machine controls cylinder 68 and one sensor 82 on the other side of the machine controls cylinders 70, FIG. 4. Sensors 82 control their respective cylinders through Proportional hydraulic valves similar to the arrangement shown in FIG. 15, with cylinder 68 (or cylinders 70) substituted for cylinder 100B, and grade control 84 in FIG. 1 substituted for sensor 82 on one side of the conveyor (and the sensor 82 on the other side controlling cylinders 70).

From the above description it will be apparent that there is provided an improved paver with the desirable advantages described above, but which obviously is susceptible to modification in its form, method, operation, detailed construction and arrangement without departing from the principles involved. It is to be understood that the invention is not limited to the specific feature shown, but that the means, method and construction herein disclosed comprise the preferred form of several modes of putting the invention into effect. The invention is, therefore, claimed in any of its forms or modifications within the legitimate and valid scope of the appended claims.

What is claimed is:

1. A paver capable of picking-up a windrow of paving material from the ground, the pave comprising:

a self-propelled chassis having a forward end and a rear end;

a pick-up means pivotally supported on the forward end of the chassis capable of conveying paving material from outside the chassis and depositing it in the chassis; and means for carrying the paving material deposited in the chassis to the ground near the rear end of the chassis;

means supported on the rear end of the chassis for producing a road surface from paving material deposited on the ground;

wherein the pick-up means is pivotally supported to pivot in two dimensions relative to the chassis; and wherein the pick-up means is pivotally supported on a mounting which is itself pivotally supported on the chassis, the pivotal support on the mounting being perpendicular to the pivotal support on the chassis.

2. The paver of claim 1 wherein a runner means is attached to the pick-up means, the runner means capable of supporting the pick-up means a predetermined distance above the round.

3. The paver of claim 2 further comprising means attached between the chassis and the pick-up means for applying a counterbalancing force on the pick-up means against the force of gravity.

4. The paver of claim 3 wherein the counterbalancing force is applied by hydraulic pressure.

5. The paver of claim 2 wherein the pick-up means comprises a lifting conveyor having input and discharge ends and means to transport paving material between the two ends, the lifting conveyor having means at its input end to feed loose paving material on the ground into the conveyor, the feed means comprising at least one grade control supported on the conveyor.

6. The paver of claim 5 wherein the feed means further comprises transverse conveyor means to convey paving material from the side of the lifting conveyor toward the means to transport paving material between the two ends.

7. The paver of claim 5 wherein the feed means has two grade controls, one on each side of the input end, and wherein the grade controls at least partially control the pivoting about the mounting.

8. The paver of claim 7 wherein the grade controls at least partially control the pivoting about the support between the mounting and the chassis.

9. The paver of claim 6 wherein the transverse conveyor means comprises a screw conveyor.

10. A paver capable of picking-up a windrow of paving material from the ground, the paver comprising:

a self-propelled chassis having a forward end and a rear end;

a pick-up means pivotally supported on the forward end of the chassis capable of conveying paving material from outside the chassis and depositing it in the chassis; and means for carrying the paving material deposited in the chassis to the ground near the rear end of the chassis;

means supported on the rear end of the chassis for producing a road surface from paving material deposited on the ground;

wherein the pick-up means is pivotally supported to pivot in two dimensions relative to the chassis; and wherein the pick-up means comprises a pan and drag chain, the drag chain being supported on drive shafts, at least one near each end of the pick-up means, and also being supported on an idler shaft above and forward of the drive shaft near the input end.

11. A paver capable of picking-up a windrow of paving material from the ground, the paver comprising:

a self-propelled chassis having forward and rear ends;

a lifting conveyor pivotally supported on the chassis, the lifting conveyor having an input end and a discharge end, the lifting conveyor comprising a pan and a drag chain having slats, the drag chain supported on one shaft near each end, and an additional shaft above and forward of the shaft near the input end;

means for carrying the paving material from the discharge end of the lifting conveyor to the ground near the rear end of the chassis;

means supported on the rear end of the chassis for producing a road surface from paving material deposited on the ground.

12. The paver of claim 11 further comprising screw conveyors extending from both sides of the input end of the lifting conveyor, the screw conveyors being driven by rotation of the input end shaft.

13. The paver of claim 11 further comprising scraper means attached to the lifting conveyor in order to prohibit passage of paving material from passing under the lifting conveyor.

14. A paver capable of picking-up a windrow of paving material from the ground, the paver comprising:

a self-propelled chassis having forward and rear ends;

a lifting conveyor pivotally supported on the chassis, the lifting conveyor having an input end and a discharge end, the lifting conveyor comprising a pan and a drag chain having slats, the drag chain supported on one shaft near each end, and an additional shaft above and forward of the shaft near the input end;

means for carrying the paving material from the discharge end of the lifting conveyor to the ground near the rear end of the chassis;

means supported on the rear end of the chassis for producing a road surface from paving material deposited on the ground; and scraper means attached to the lifting conveyor in order to prohibit passage of paving material from passing under the lifting conveyor;

wherein the scraper means is pivotally attached to the lifting conveyor and secured by a break-away pin; and wherein application of a predetermined force will sever the break-away pin and pivot the scraper means in the direction of the force.

15. A paver capable of picking-up a windrow of paving material from the ground, the paver comprising:

a self-propelled chassis having a forward end and a rear end;

conveyor means pivotally supported on the forward end of the chassis capable of conveying paving material from a windrow to the chassis;

means for conveying paving material in the chassis to the ground near the rear end of the chassis;

means supported on the rear end of the chassis for producing a road surface from the paving material deposited on the ground;

runner means attached to the conveyor means capable of being fixed at a predetermined distance below the conveyor;

wherein the runner means prohibits the conveyor from resting on the ground; and at least one scrapper means attached to the conveyor;

wherein the scraper projects below the conveyor means the same distance as the runner means maintains the conveyor means above the ground.

16. The paver of claim 15 further comprising means attached between the chassis and the conveyor means for applying a force on the conveyor means.

17. The paver of claim 16 wherein the means for applying the force is a hydraulic cylinder.

18. The paver of claim 15 further comprising at least one scraper attached to the rear of the conveyor to prohibit paving material from passing beneath the conveyor.

19. The paver of claim 18 wherein the scraper projects below the conveyor means a smaller distance than the distance the runner means supports the conveyor means above the ground whereby a mat of paving material is formed by the scraper when the conveying means passes over a windrow.

20. A paver capable of picking-up a windrow of paving material from the ground, the paver comprising:

a self-propelled chassis having a forward end and a rear end;

conveyor means pivotally supported on the forward end of the chassis capable of conveying paving material in a windrow to the chassis;

means for conveying paving material in the chassis to the ground near the rear end of the chassis;

means supported on the rear end of the chassis for producing a road surface from the paving material deposited on the ground;

runner means for riding on the ground, the runner means attached to the conveyor means such that it can float relative to the ground; and, scraper means moveably attached to the conveyor means and communicating with the runner means such that the scraper means floats with the runner means;

whereby communication between the runner means and the scraper means maintains a constant distance between the scraper means and the ground.

21. A paver capable of picking-up a windrow of paving material from the ground, the paver comprising:

a self-propelled chassis having a forward end and a rear end;

conveyor means pivotally supported on the forward end of the chassis capable of conveying paving material in a windrow to the chassis;

means for conveying paving material in the chassis to the ground near the rear end of the chassis;

means supported on the rear end of the chassis for producing a road surface from the paving material deposited on the ground;

runner means for riding on the ground, the runner means attached to the conveyor means such that it can float relative to the ground; and, scraper means moveably attached to the conveyor means and communicating with the runner means such that the scraper means floats with the runner means;

wherein the scraper means comprises a bracket attached to the conveyor and a scraper plate attached to the bracket at a pivot point and at a break-away pin;

whereby the distance between the scraper means and the ground is maintained constant; and whereby application of at least a predetermined force will sever the break-away pin and pivot the scraper plate in the direction of said force.

22. The paver of claim 20 wherein the runner means communicates with the scraper means such that vertical movement of the runner means causes a corresponding vertical movement of the scraper means.

23. The paver of claim 22 wherein the controlled downward force is applied against both the runner means and the scraper means.

24. The paver of claim 23 wherein the controlled downward force is applied by a hydraulic cylinder and wherein the controlled downward force is adjustable.

25. The paver of claim 24 wherein the position of the scraper means relative to the runner means is adjustable such that the height of the scraper means above the ground can be predetermined.

26. A paver capable of picking-up a windrow of paving material from the ground, the paver comprising:

a self-propelled chassis having a forward end and a rear end;

conveyor means pivotally supported on the forward end of the chassis capable of conveying paving material in a windrow to the chassis;

means supported on the rear end of the chassis for producing a road surface from the paving material deposited on the ground;

scraper means moveably attached to the conveyor means to restrict at least a portion of the paving material from passing under the conveyor means;

grade control means capable of riding along the ground, the grade control means directly communicating with the scraper means to maintain the scraper means at a predetermined height above the ground.

27. The paver of claim 26 wherein movement of the scraper means is effected by a hydraulic cylinder attached to the conveyor means and wherein the grade control means communicated with a hydraulic radial proportional valve which in-turn communicates with the hydraulic cylinder.

28. The paver of claim 26 wherein the grade control means comprises a runner means to ride on the ground, the runner means being attached to the scraper means.

29. A paver capable of picking-up a windrow of paving material from the ground, the paver comprising:

a self-propelled chassis having a forward end and a rear end;

conveyor means pivotally supported on the forward end of the chassis capable of conveying paving material in a windrow to the chassis;

means supported on the rear end of the chassis for producing a road surface from the paving material deposited on the ground;

scraper means moveably attached to the conveyor means to restrict at least a portion of the paving material from passing under the conveyor means;

grade control means capable of riding along the ground, the grade control means communicating with the scraper means an maintaining the scraper means at a predetermined height above the ground;

wherein the scraper means is attached to the conveyor means at a pivot connection and by a break-away pin, and wherein the application of a predetermined amount of force against the scraper means will sever the break-away pin and pivot the scraper means about the pivot connection in the direction of the force.

30. A method of paving a road with paving material laid in a windrow utilizing a self-propelled chassis having a forward end supporting a conveyor means capable of picking-up paving material from a windrow and depositing it in the chassis, and the chassis having a rear end supporting means for producing a road surface from paving material deposited on the ground, the method comprising the steps of:

supporting the conveyor means off the ground by runner means capable of sliding along the ground and also capable of vertical movement relative to the conveyor means; and providing scraper means attached to the conveyor means and communicating with the runner means, the scraper means capable of vertical movement relative to the conveyor means, said scraper means movement corresponding to the movement of the runner means.

31. A pick-up apparatus adapted to transfer at least a portion of a windrow of paving material from the ground to a paver, the pick-up comprising:

a chassis;

a conveyor at least partially supported on the chassis;

scraper means attached to the conveyor to prohibit passage of paving material from under at least a portion of the conveyor, the scraper means capable of rearward movement relative to the conveyor upon application of at least a predetermined force.

32. The pick-up apparatus of claim 31 further comprising ground-engaging means communicating with the conveyor, the ground-engaging means at least partially supporting the conveyor.

33. The pick-up apparatus of claim 32 wherein the ground-engaging means are runners.

34. The pick-up apparatus of claim 31 wherein the scraper means is pivotally attached to the conveyor and secured against the predetermined force by a break-away pin.

35. The pick-up apparatus of claim 31 wherein the scraper means projects downwardly from the conveyor, the distance that it projects being manually adjustable.

36. The pick-up apparatus of claim 32 wherein the ground-engaging means is adjustable to vary the height of the conveyor above the ground.

37. The pick up apparatus of claim 31 wherein the scraper means is biased downward to engage the ground.

38. A pick-up apparatus adapted to transfer at least a portion of a windrow of paving material from the ground to a paver, the pick-up comprising:

a chassis;

a conveyor at least partially supported on the chassis;

scraper means pivotally attached to the conveyor and projecting downwardly from the conveyor to prohibit passage of paving material from under at least a portion of the conveyor, the scraper means capable of rearward movement relative to the conveyor upon application of at least a predetermined force, the scraper means secured against the force by a break-away pin, the scraper means being biased downward to engage the ground; and ground engaging means communicating with the conveyor and at least partially supporting the conveyor, the ground-engaging means being adjustable to vary the height of the conveyor above the ground.

39. A pick-up apparatus adapted to transfer at least a portion of a windrow of paving material from the ground to a paver, the pick-up comprising:

a chassis;

a conveyor pivotally supported on the chassis;

transverse conveyor means attached to the conveyor to move windrow material from a position transversely outside the conveyor to the conveyor;

scraper means attached to the transverse conveyor to prohibit passage of material from under at least a portion of the transverse conveyor means;

wherein the scraper means is biased downward to engage the ground.

40. The pick-up apparatus of claim 39 wherein the transverse conveyor means is a screw conveyor.

41. The pick-up apparatus of claim 39 wherein the scraper means will move rearwardly relative to the conveyor upon application of at least a predetermined force.

42. The pick-up apparatus of claim 41 wherein the scraper means is pivotally connected to the conveyor and secured against rearward movement by a break-away pin.

43. The pick-up apparatus of claim 41 further comprising ground-engaging means at least partially supporting the conveyor, the ground-engaging means being adjustable to vary the height of the conveyor.

44. A pick-up apparatus adapted to transfer at least a portion of a windrow of paving material from the ground to a paver, the pick-up comprising:

a chassis;

a conveyor pivotally supported on the chassis;

a screw conveyor attached to the conveyor to move windrow material from a portion transverse the conveyor to the conveyor;

scraper means pivotally connected to the screw conveyor to prohibit passage of material from under at least a portion of the screw conveyor, the scraper means being biased downward to engage the ground, the scraper means being secured against rearward movement by a break-away pin that will release upon application of at least a predetermined force; and ground engaging means at least partially supporting the conveyor, the ground engaging means being adjustable to vary the height of the conveyor.

* * * * *